US008060981B2

(12) United States Patent
Bassett et al.

(10) Patent No.: US 8,060,981 B2
(45) Date of Patent: Nov. 22, 2011

(54) UPRIGHT VACUUM CLEANER

(75) Inventors: Alexander Anthony Denny Bassett, Kenilworth (GB); Steven Xue, JiangSu (CN)

(73) Assignee: Hoover Limited, Pentrebach (GB)

( * ) Notice: Subject to any disclaimer, the term of this patent is extended or adjusted under 35 U.S.C. 154(b) by 686 days.

(21) Appl. No.: 12/102,209

(22) Filed: Apr. 14, 2008

(65) Prior Publication Data

US 2008/0263814 A1 Oct. 30, 2008

(30) Foreign Application Priority Data

Apr. 27, 2007 (GB) ..... 0708129.2

(51) Int. Cl.
*A47L 5/28* (2006.01)

(52) U.S. Cl. ..... 15/410; 15/351

(58) Field of Classification Search ..... 15/351, 15/410, 411; *A47L 5/28, 9/02*
See application file for complete search history.

(56) References Cited

U.S. PATENT DOCUMENTS

| | | | | |
|---|---|---|---|---|
| 1,791,423 | A * | 2/1931 | Meier | 403/95 |
| 3,512,207 | A | 5/1970 | Ettridge | |
| 5,584,095 | A * | 12/1996 | Redding et al. | 15/411 |
| 2003/0145422 | A1 * | 8/2003 | Kaffenberger et al. | |

FOREIGN PATENT DOCUMENTS

| | | | |
|---|---|---|---|
| EP | 07078613 | * | 8/2000 |
| GB | 481679 | | 3/1938 |
| GB | 2384694 | * | 8/2003 |
| GB | 2403135 | * | 12/2004 |
| WO | WO2004/014211 | * | 2/2004 |

* cited by examiner

*Primary Examiner* — David A Redding
(74) *Attorney, Agent, or Firm* — Gordon & Jacobson, PC

(57) ABSTRACT

A steerable vacuum cleaner comprises an upright body portion which is pivotally mounted at its lower end to the rear of a wheeled floor-engaging head portion. A catch is pivotally mounted intermediate its opposite ends to the upright body portion, the catch having a finger at a forward end arranged to engage a formation on the head portion. The rearward end of the catch defines a foot pedal for moving the forward end of the catch out of engagement with the formation. The catch on the body portion can engage the head portion to prevent the head portion from pivoting sideways and rearwards when the cleaner is not in use.

10 Claims, 2 Drawing Sheets

UPRIGHT VACUUM CLEANER

RELATED APPLICATION

This application claims benefit from GB 0708129.2, filed Apr. 27, 2007, which is hereby incorporated by reference herein in its entirety.

BACKGROUND OF THE INVENTION

1. Field of the Invention

This invention relates to an upright vacuum cleaner and more particularly to an upright vacuum cleaner having a steerable head.

2. State of the Art

Conventional upright vacuum cleaners generally comprise an upright body portion having an upstanding handle. The lower end of the upright body portion is pivotally connected for forwards and rearwards movement to a wheeled floor-engaging head portion.

Upright vacuum cleaners are commonly provided with a lock which locks the body portion and head portion together, in order to maintain the body portion in an upright position when not in use or when using any elongate flexible cleaning hose of the kind provided on many vacuum cleaners. Typically, the lock comprises a foot pedal, which must be depressed to release the lock, although some vacuum cleaners incorporate a lock which is released by applying an excessive rearwards force to the body portion.

Conventional upright vacuum cleaners can sometimes be difficult to maneuver around obstacles such as furniture. An upright vacuum cleaner having a wheeled floor engaging head portion, which can be steered by twisting the handle on the body portion about its longitudinal axis is disclosed in EP7078613 and comprises an universal joint which couples the floor-engaging head portion to the body portion and which permits rotational movement in two orthogonal axes, so that the body portion can pivot sideways as well as forwardly and rearwardly.

Such so-called steerable vacuum cleaners are difficult to move sideways to lock the body portion in the upright position using a conventional locking mechanism.

WO2004/014211 discloses a steerable upright vacuum cleaner having a stand pivotally mounted to the rear of the cleaner which can be folded down to maintain the body portion in its upright position. This arrangement is complex, flimsy and unsightly.

SUMMARY OF THE INVENTION

In accordance with the present invention, there is provided a vacuum cleaner having an upright body portion which is pivotally mounted at its lower end to the rear of a wheeled floor-engaging head portion, the vacuum cleaner further comprising a catch pivotally mounted intermediate its opposite ends to the upright body portion, the catch having a forward end arranged to engage a formation on the head portion and a rearward end defining an actuator for moving the forward end of the catch out of engagement with the formation.

In use, the catch on the upright body portion engages the head portion, thereby preventing the body portion from pivoting sideways and rearwards. In this manner, the body portion is securely retained in its upright position against the head portion. The arrangement is simple in construction, yet is easy to operate and is not unsightly.

Preferably the rear of the head portion has a recess in the rear thereof, the catch serving to retain the body portion in said recess when the body is in its upright position.

Preferably the recess faces rearwardly and comprises side walls which diverge outwardly in order to laterally center the body portion as the latter is pivoted forwardly into its upright position.

Preferably the body portion comprises a housing and a neck which extends between the housing and the head portion of the vacuum cleaner.

Preferably the catch is pivotally mounted to the neck, the neck preferably being received in said recess.

Preferably the neck forms an airflow duct between the head and body portion of the vacuum cleaner.

Preferably the neck is arranged to pivot about a first axis which extends generally transverse the head, the neck further being arranged to pivot about a second axis which extends substantially perpendicular to said first axis: this arrangement thus forms a universal joint between the head and body portions of the vacuum cleaner whereby rotation of the neck about its longitudinal axis gives rise to steering movement of the head.

Preferably the catch is disposed on the neck between the universal joint and the housing. The position of the arm on the neck means that it is conveniently located, enabling the actuator to be operated by the user's foot.

Preferably the catch is pivotally connected to said body portion for upwards and downwards movement, the actuator being arranged for pivoting the arm upwardly and downwardly.

Preferably the arm is biased downwardly to engage the head portion when the body portion is returned to the upright position.

Preferably the catch embraces the neck.

BRIEF DESCRIPTION OF THE DRAWINGS

An embodiment of the present invention will now be described by a way of an example only and with reference to the accompanying drawings.

DETAILED DESCRIPTION OF THE PREFERRED EMBODIMENT

Figure 1:
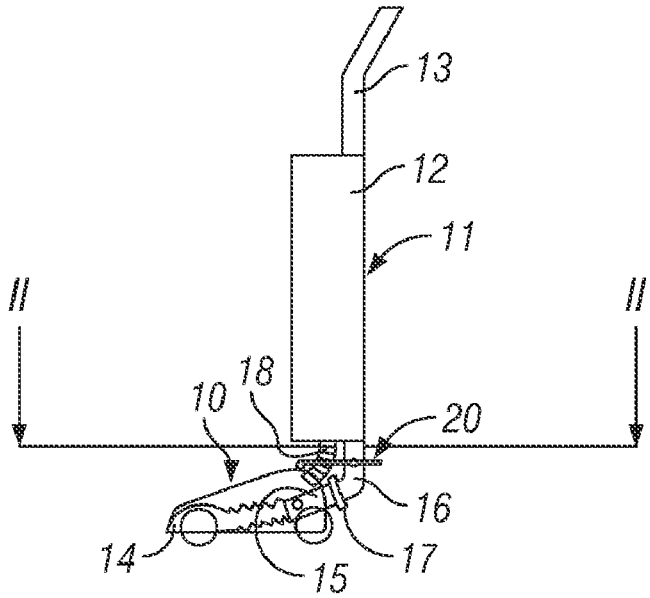
FIG. 1 is a schematic side view of an upright vacuum cleaner in accordance with the present invention.

Referring to FIG. 1 of the drawings, there is shown a steerable upright vacuum cleaner comprising a wheeled floor-engaging head portion 10, which is pivotally connected at its rear to an upright body portion 11. The body portion 11 comprises a housing 12 containing a dust separator (not shown), such as a filter bag or cyclone. An elongate handle 13 extends upwardly from the upper end of the housing 12 of the body portion 11.

The head portion 10 comprises an inlet 14 on its underside, through which dirty air is drawn into the vacuum cleaner by a motor-fan assembly (not shown). An agitator brush (not shown) is rotatably mounted across the inlet 14. The inlet 14 is connected via a flexible duct to the proximal end of a tube 15 which projects rearwardly from the head portion 10. The proximal end of tube 15 is pivotally mounted to the head portion 10 for rotation about a horizontal axis, such that the distal end of the tube 15 is able to move upwardly and downwardly. The distal end of the tube 15 is provided with a collar 17 which embraces a peripheral flange formed on the lower end of a cranked tube 16 which depends from the underside of the housing 12 of the body portion 11. The collar 17 couples the two tubes 15, 16 in such a manner as to allow the cranked tube 16 to rotate about the longitudinal axis of its lower end.

The upper end of the tube 16 extends into the housing 12 of the body portion 11 and into the inlet of the dust separator (not shown). In the embodiment shown, the motor-fan unit (not shown) is disposed in the head portion 10 of the cleaner and is connected to the outlet of the dust separator by an elongate flexible duct 18 which extends between the head portion 10 and the body portion 11 of the cleaner.

It will be appreciated that the pivotal arrangement of the proximal end of the tube 15 to the head portion 10 of the vacuum cleaner allows the body portion 11 of the vacuum cleaner to pivot forwardly and rearwardly, whilst the nature of the rotational coupling between the tubes 15 and 16 allows the body portion 11 to pivot from side-to-side. In use, the head portion 10 of the cleaner can thus be steered by imparting a twisting movement to the handle 13. The tubes 15, 16 also serve to support the body portion 11 of the cleaner.

Figure 2:
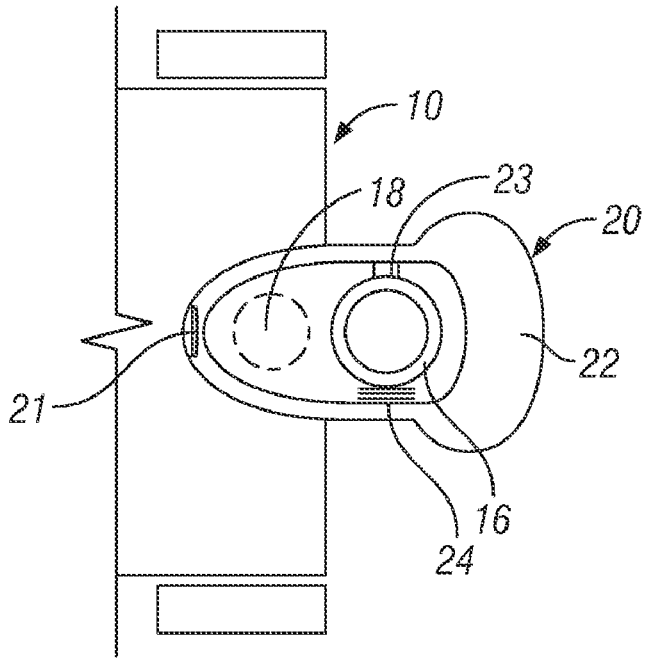
FIG. 2 is a sectional view along the line II-II of FIG. 1.
Figure 3:
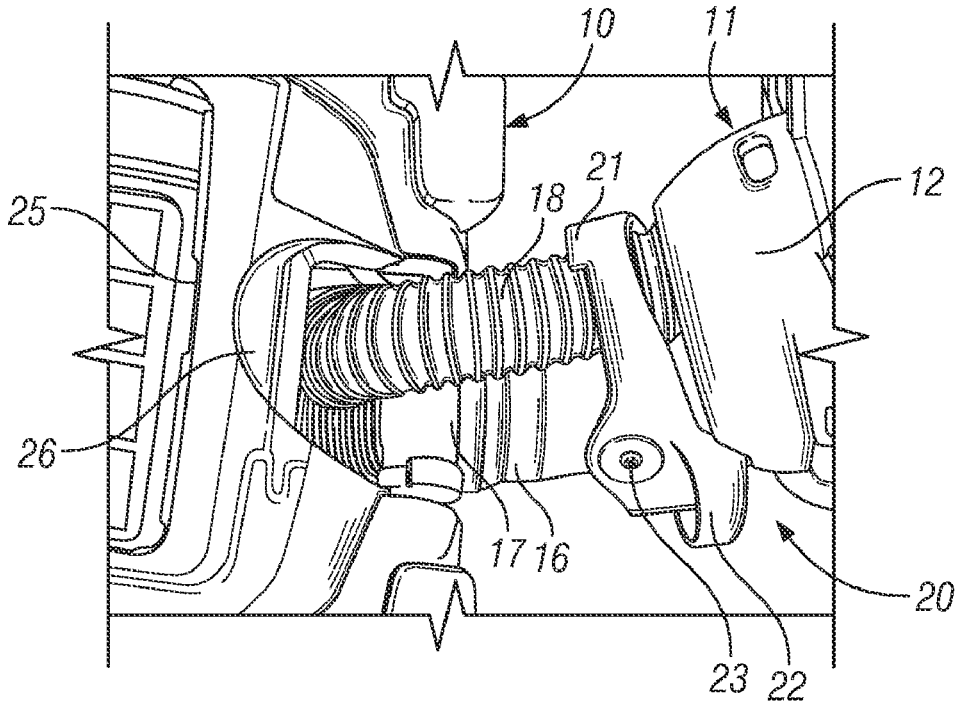
FIG. 3 is a perspective view from one side and above of a portion of the vacuum cleaner of FIG. 1.
Figure 4:
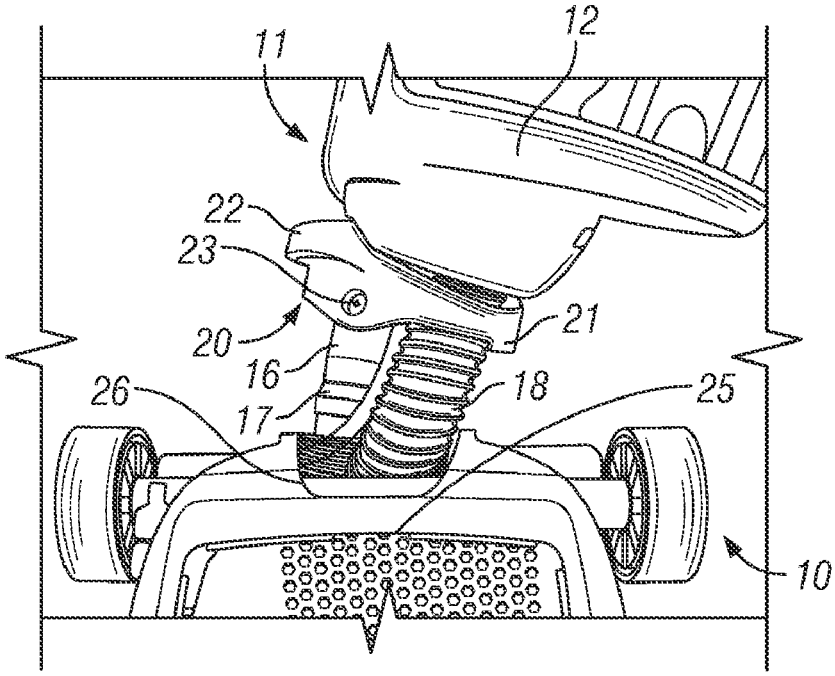
FIG. 4 is a perspective view from the front and above of the portion of the vacuum cleaner of FIG. 1.

Referring to FIGS. 2 to 4 of the drawings, a catch 20 is pivotally mounted to the tube 16 on an axle 23. The catch 20 is generally ellipsoidal in shape and comprises a central aperture through which both the tube 16 and duct 18 extend. The catch 20 comprises a forward end, which is provided with a depending finger 21. The rearward end of the catch 20 is enlarged to define a foot pedal 22. A torsional coil spring 24 is mounted on the axle 23 of the catch member 20, in order to bias the forward end of the catch 20 downwardly.

The head portion 10 of the cleaner comprises an external housing, which is provided with a detent 25 on its upper surface, the finger 21 on the catch 20 being arranged to engage into the detent 25 when the body portion 11 is in its fully upright position.

In order to release the catch 20, a downward force can be applied to the pedal 22. The body portion 11 of the cleaner can then be pivoted rearwardly and the handle 13 can be twisted about its longitudinal axis to steer the cleaner.

Following use, the body portion 11 of the cleaner can be pivoted forwardly into a recess 26 formed at the rear of the head portion 10. The side walls of the recess 26 converge inwardly, thereby bringing the body 11 of the cleaner into its laterally centred position. Continued forward movement of the body portion 11 causes the forward end of the catch 20 to engage the head 10, whereupon it is lifted upwardly against the bias of the spring 24 until the finger 21 thereon engages over the detent 25.

The engagement of the catch 20 with the detents 25 prevents the body portion 11 of the cleaner from pivoting sidewardly or rearwardly and thereby maintains it in an upright position for storage or when using an elongate flexible tube (not shown).

In an alternative embodiment, the catch 20 may be mounted on the housing 12.

The catch 20 is simple and inexpensive in construction, yet is able to effectively hold the body of the cleaner in its upright position without detracting from the overall appearance of the vacuum cleaner.

While the preferred embodiment of the invention have been shown and described, it will be understood by those skilled in the art that changes of modifications may be made thereto without departing from the true spirit and scope of the invention.

The invention claimed is:

1. A vacuum cleaner comprising:

a wheeled floor-engaging head portion with a rear part;

an upright body portion including a housing and a neck which depends from the housing and which is pivotally mounted at its lower end to the rear part of said head portion, wherein the neck forms an airflow duct between the head portion and the housing; and a catch pivotally mounted intermediate its opposite ends to the upright body portion, the catch having a forward end arranged to engage a formation on the head portion and a rearward end defining an actuator for moving the forward end of the catch out of engagement with the formation.

2. A vacuum cleaner as claimed in claim 1, wherein:

the head portion has a recess in the rear part thereof, and the catch serves to retain the body portion in said recess when the body is in an upright position.

3. A vacuum cleaner as claimed in claim 2, wherein:

the recess faces rearwardly and comprises side walls which diverge outwardly.

4. A vacuum cleaner as claimed in claim 1, wherein:

the catch is pivotally mounted to the neck.

5. A vacuum cleaner as claimed in claim 1, wherein:

the head portion has a recess in the rear part thereof, the neck being received in said recess.

6. A vacuum cleaner as claimed in claim 1, wherein:

the neck is arranged to pivot at a first pivot location about a first axis which extends generally transverse the head, the neck further being arranged to pivot at a second pivot location about a second axis which extends substantially perpendicular to said first axis.

7. A vacuum cleaner as claimed in claim 6, wherein:

the catch is disposed on the neck between said first and second pivot locations and the housing.

8. A vacuum cleaner as claimed in claim 1 , wherein:

the catch embraces the neck.

9. A vacuum cleaner as claimed in claim 1, wherein:

the catch includes an arm which is pivotally connected to said body portion for upwards and downwards movement, the actuator being arranged for pivoting the arm upwardly and downwardly.

10. A vacuum cleaner as claimed in claim 9, wherein:

the arm is biased downwardly to engage the head portion when the body portion is returned to an upright position.

* * * * *